US007828706B2

(12) United States Patent
Medina

(10) Patent No.: US 7,828,706 B2
(45) Date of Patent: Nov. 9, 2010

(54) BILATERALLY ACTUATED SCULLING TRAINER

(76) Inventor: Rafael R. Medina, 330 Renaissance Dr., P.O. Box 222, Williamsville, NY (US) 14231

( * ) Notice: Subject to any disclaimer, the term of this patent is extended or adjusted under 35 U.S.C. 154(b) by 0 days.

(21) Appl. No.: 12/115,211

(22) Filed: May 5, 2008

(65) Prior Publication Data

US 2008/0305934 A1 Dec. 11, 2008

Related U.S. Application Data

(60) Provisional application No. 60/916,037, filed on May 4, 2007.

(51) Int. Cl.
*A63B 23/00* (2006.01)

(52) U.S. Cl. ..... 482/148; 482/92; 482/72; 482/5

(58) Field of Classification Search ..... 482/72, 482/148
See application file for complete search history.

(56) References Cited

U.S. PATENT DOCUMENTS

| | | | | | |
|---|---|---|---|---|---|
| 641,596 | A | * | 1/1900 | Kerns | 482/72 |
| 1,111,269 | A | * | 9/1914 | Medart | 482/72 |
| 1,504,375 | A | * | 8/1924 | Phillips | 482/73 |
| 1,707,791 | A | * | 4/1929 | Anderson | 482/72 |
| 1,905,092 | A | * | 4/1933 | Hardy | 482/72 |
| 3,266,801 | A | * | 8/1966 | Johnson | 482/73 |
| 3,473,843 | A | * | 10/1969 | Hart | 297/130 |
| 3,528,653 | A | * | 9/1970 | Ross et al. | 482/72 |
| 3,589,720 | A | * | 6/1971 | Agamian | 482/114 |
| 3,912,264 | A | * | 10/1975 | Busse et al. | 482/72 |
| 4,044,628 | A | * | 8/1977 | Jacks | 74/574.2 |
| D277,304 | S | * | 1/1985 | Smith et al. | D21/674 |
| 4,563,000 | A | * | 1/1986 | Gall | 482/72 |
| D287,389 | S | * | 12/1986 | Nadeau | D21/674 |
| 4,674,741 | A | * | 6/1987 | Pasierb et al. | 482/72 |
| 4,684,126 | A | * | 8/1987 | Dalebout et al. | 482/138 |
| 4,714,244 | A | * | 12/1987 | Kolomayets et al. | 482/72 |
| 4,728,099 | A | * | 3/1988 | Pitre | 482/72 |
| 4,735,410 | A | | 4/1988 | Nobuta | |
| 4,743,010 | A | * | 5/1988 | Geraci | 482/72 |
| 4,743,011 | A | * | 5/1988 | Coffey | 482/73 |
| 4,750,736 | A | * | 6/1988 | Watterson | 482/73 |

(Continued)

FOREIGN PATENT DOCUMENTS

DE 102004051806 A1 4/2006

(Continued)

OTHER PUBLICATIONS

International Search Report and Written Opinion issued in related PCT Patent Application Serial No. PCT/US2008/062651, 5 pages, Jun. 24, 2008.

*Primary Examiner*—Steve R Crow
*Assistant Examiner*—Robert F Long
(74) *Attorney, Agent, or Firm*—Lathrop & Gage LLP

(57) ABSTRACT

An apparatus for simulating sculling or rowing on water includes a support frame with foot rests, a sliding seat, bilateral oars that are rotationally coupled to a set of actuators, integrated input velocity and torque sensors, computer and computer display. Each actuator incorporates a mechanical transmission, a rotational inertial mass, a variable linear and a variable non-linear damping element. The damping elements can be controlled manually or automatically by computer programs under user control.

9 Claims, 14 Drawing Sheets

U.S. PATENT DOCUMENTS 4,765,315 A * 8/1988 Krukowski ..... 601/32
D297,853 S * 9/1988 Ostrom ..... D21/674
4,869,497 A * 9/1989 Stewart et al. ..... 482/5
4,875,674 A * 10/1989 Dreissigacker et al. ..... 482/9
D306,750 S * 3/1990 Kiiski ..... D21/674
4,974,832 A * 12/1990 Dalebout ..... 482/72
4,984,986 A * 1/1991 Vohnout ..... 434/247
5,099,689 A * 3/1992 McGinn ..... 73/379.01
5,104,363 A * 4/1992 Shi ..... 482/73
5,131,895 A * 7/1992 Rogers, Jr. ..... 482/70
5,186,695 A * 2/1993 Mangseth et al. ..... 482/6
D337,799 S * 7/1993 Cutter et al. ..... D21/674
5,312,315 A * 5/1994 Mortensen et al. ..... 482/113
D354,099 S * 1/1995 Gerschefske et al. ..... D21/668
5,387,169 A * 2/1995 Wang ..... 482/73
D357,041 S * 4/1995 McBride et al. ..... D21/676
5,407,409 A * 4/1995 Tang ..... 482/70
D358,624 S * 5/1995 Wang et al. ..... D21/673
5,441,469 A * 8/1995 Chern ..... 482/72
D362,283 S * 9/1995 Lee ..... D21/674
5,478,296 A * 12/1995 Lee ..... 482/73
5,489,249 A * 2/1996 Brewer et al. ..... 482/5
5,505,679 A * 4/1996 McBride et al. ..... 482/53
5,554,086 A * 9/1996 Habing et al. ..... 482/137
D375,767 S * 11/1996 Camfield et al. ..... D21/668
5,575,740 A * 11/1996 Piaget et al. ..... 482/70
5,580,340 A * 12/1996 Yu ..... 482/96
D378,110 S * 2/1997 Collinsworth ..... D21/690
5,611,758 A * 3/1997 Rodgers, Jr. ..... 482/57
D390,289 S * 2/1998 Chen ..... D21/668
5,722,921 A * 3/1998 Simonson ..... 482/100
5,779,600 A * 7/1998 Pape ..... 482/72
5,795,270 A * 8/1998 Woods et al. ..... 482/72
D397,745 S * 9/1998 Wu ..... D21/668
D414,519 S * 9/1999 Wang et al. ..... D21/676
D425,585 S * 5/2000 Wu ..... D21/676
6,071,215 A * 6/2000 Raffo et al. ..... 482/57
6,093,135 A * 7/2000 Huang ..... 482/72
6,135,930 A * 10/2000 Kuo ..... 482/72
6,196,954 B1 * 3/2001 Chen ..... 482/131
6,224,519 B1 * 5/2001 Doolittle ..... 482/98
6,361,479 B1 * 3/2002 Hildebrandt et al. ..... 482/72
6,371,895 B1 * 4/2002 Endelman et al. ..... 482/135
6,450,922 B1 * 9/2002 Henderson et al. ..... 482/8
6,540,650 B1 * 4/2003 Krull ..... 482/107
6,565,495 B2 * 5/2003 Slattery ..... 482/142
6,602,168 B2 * 8/2003 Duke ..... 482/72
6,692,410 B1 * 2/2004 Lai ..... 482/52
6,790,178 B1 * 9/2004 Mault et al. ..... 600/300
7,232,404 B2 * 6/2007 Nelson ..... 482/140
7,252,627 B2 * 8/2007 Carter ..... 482/98
7,413,532 B1 * 8/2008 Monsrud et al. ..... 482/99
7,455,633 B2 * 11/2008 Brown et al. ..... 482/142
D584,367 S * 1/2009 Augustine et al. ..... D21/662
7,537,546 B2 * 5/2009 Watterson et al. ..... 482/8
2001/0027150 A1 * 10/2001 Duke ..... 482/72
2002/0151415 A1 * 10/2002 Hildebrandt et al. ..... 482/57
2003/0045406 A1 * 3/2003 Stone ..... 482/100
2004/0127335 A1 * 7/2004 Watterson et al. ..... 482/8
2004/0171460 A1 * 9/2004 Park ..... 482/8
2005/0032611 A1 * 2/2005 Webber et al. ..... 482/72
2005/0130802 A1 * 6/2005 Kinnunen et al. ..... 482/8
2005/0130810 A1 * 6/2005 Sands ..... 482/72
2005/0197237 A1 * 9/2005 Chen ..... 482/8
2006/0020177 A1 * 1/2006 Seo et al. ..... 600/300
2006/0166798 A1 * 7/2006 Nelson ..... 482/140
2007/0142177 A1 * 6/2007 Simms et al. ..... 482/8
2007/0149370 A1 * 6/2007 Brown et al. ..... 482/140
2007/0173377 A1 * 7/2007 Jamsen et al. ..... 482/8
2007/0287597 A1 * 12/2007 Cameron ..... 482/8
2008/0070765 A1 * 3/2008 Brown et al. ..... 482/140
2008/0070766 A1 * 3/2008 Brown et al. ..... 482/140
2008/0108442 A1 * 5/2008 Jansen et al. ..... 464/54
2008/0125291 A1 * 5/2008 Watt et al. ..... 482/52
2008/0176713 A1 * 7/2008 Olivera Brizzio et al. ..... 482/8
2009/0018000 A1 * 1/2009 Brown et al. ..... 482/140
2009/0036276 A1 * 2/2009 Loach ..... 482/72
2009/0069156 A1 * 3/2009 Kurunmaki et al. ..... 482/9

FOREIGN PATENT DOCUMENTS

WO 2004026412 A 4/2004

* cited by examiner

BILATERALLY ACTUATED SCULLING TRAINER

CROSS-REFERENCES TO RELATED APPLICATIONS

This application is related to and claims priority from U.S. Provisional Patent Application Ser. No. 60/916,037, entitled: Sculling Apparatus, filed on May 4, 2007, the disclosure of which is incorporated by reference herein.

BACKGROUND

Rowing or sculling on water are enjoyable forms of recreation and exercise. In terms of exercise, the rower or sculler benefits from a full body exercise, as rowing and sculling involves exercising numerous muscle groups of the torso and upper and lower extremities. However, those who enjoy this outdoor activity are limited by proximity to a large body of water or by ambient weather conditions.

In order to have rowing or sculling always available, regardless of weather or geography, machines attempting to simulate the rowing or sculling experience have been developed in the past. However, these machines remain limited because of their use of spring based or dashpot based resistance to motion, unilateral actuation or they are cumbersome. A user may experience a semblance of rowing by moving members simulating oars however, rowing loads as reflected to the user by the machine may not be realistic or predictable. Accordingly, the rowing experience, provided by prior designs, may not simulate well the sensation of rowing or sculling on water.

SUMMARY

The disclosed subject matter provides an apparatus and method that simulates rowing or sculling on water. The disclosed subject matter simulates the sensation of rowing on water, as it models the inertial and damping properties of water. The simulation is provided by linear and non-linear dampers, working in conjunction, to provide resistance at the oars, similar to the resistance provided by water.

The disclosed subject matter is directed to an apparatus for simulating sculling or rowing on water. The apparatus includes a support frame with foot rests, a sliding seat, bilateral oars that are rotationally coupled to a set of actuators, integrated input velocity and torque sensors, computer and computer display. Each actuator incorporates a mechanical transmission, a rotational inertial mass, a variable linear and a variable non-linear damping element. The damping elements can be controlled manually or automatically by computer programs under user control.

The disclosed subject matter, is directed to a bilateral sculling trainer. The sculling trainer includes a main frame supporting a pair of first and second simulated oars. The oars respectively rotate about first and second rotational axes that are defined by the rotational axis of first and second transmissions or actuators. The first and second transmissions transmit respective rotations of the first and second simulated oars around the first and second rotational axes. Incorporated within the transmissions are first and second inertial members that are respectively rotatable around the first and second rotational axes. Additionally, the first and second transmissions include corresponding first and second speed changers that convert relatively high-torque, low-angular-speed rotation of the first and second simulated oars into relatively low-torque, high-angular-speed rotation of the first and second inertial members around the first and second rotational axes.

The sculling trainer also has first and second variable dampers for respectively resisting rotation of the first and second inertial members. These first and second variable dampers include first and second variable non-linear dampers, for example, air dampers, and first and second variable linear dampers, for example, magnetic dampers.

There is disclosed an apparatus for simulating sculling, rowing or the like. The apparatus includes, a main frame for supporting first and second simulated oars, that are rotatable about respective first and second rotational axes and an actuator for receiving each of the first simulated oar and the second simulated oar. Each actuator includes a drive assembly for transmitting the rotations of the corresponding oar about the respective rotational axis; at least one angular velocity sensor for detecting the angular velocity of each oar; at least one torque sensor unit for determining the torque on each oar; and a damping system. The damping system is electronically coupled with the at least one angular velocity sensor and the at least one torque sensor. The damping system provides linear and non-linear damping to create a damping load on the drive assembly based on the detected angular velocity and the torque on the first and second simulated oars. Non-linear damping is provided, for example, by non-linear dampers, such as variable air, fluid or viscous dampers, while linear damping is provided, for example, by linear dampers, such as magnetic dampers.

The apparatus may also include a processor, for example, a microprocessor. The processor is programmed to receive signals corresponding to the sensed angular velocites of each oar and to receive signals corresponding to the torque on each oar, determine damping output for the damping system from these received signals, and, send signals to the damping system for controlling the linear and non-linear damping.

Also disclosed is an actuator apparatus for an object, for example, an oar or simulated oar, rotating about a rotational axis. The actuator includes a drive assembly for transmitting the rotations of the object about the rotational axis, at least one angular velocity sensor for detecting the angular velocity of the object, at least one torque sensor unit for determining the torque on the object, and, a damping system. The damping system is electronically coupled to the at least one angular velocity sensor and the at least one torque sensor. The damping system provides linear and non-linear damping to create a damping load on the drive assembly based on the detected angular velocity and the torque on the object. Non-linear damping is provided, for example, by non-linear dampers, such as variable air, fluid or viscous dampers, while linear damping is provided, for example, by linear dampers, such as magnetic dampers.

Also disclosed is a method for simulating movement along water. The method includes receiving angular velocity and torque data from at least one simulated oar in a rotation about a rotational axis, and, determining a damping load for a drive assembly, that is coupled with the at least one simulated oar, from the received angular velocity and torque data, the damping load including non-linear and linear damping components. The drive assembly is then subjected to determined damping load, to damp the motion of the oar, to simulate the resistance of water. The angular velocity and torque data, is, for example, in the form of electrical signals. The non-linear damping component, for example, includes a square law function, while the linear damping component includes, for example, a linear function.

BRIEF DESCRIPTION OF THE DRAWINGS

Attention is now directed to the drawings, where like reference numerals or characters indicate corresponding or like components. In the drawings.

DETAILED DESCRIPTION OF THE DRAWINGS

Figure 1:
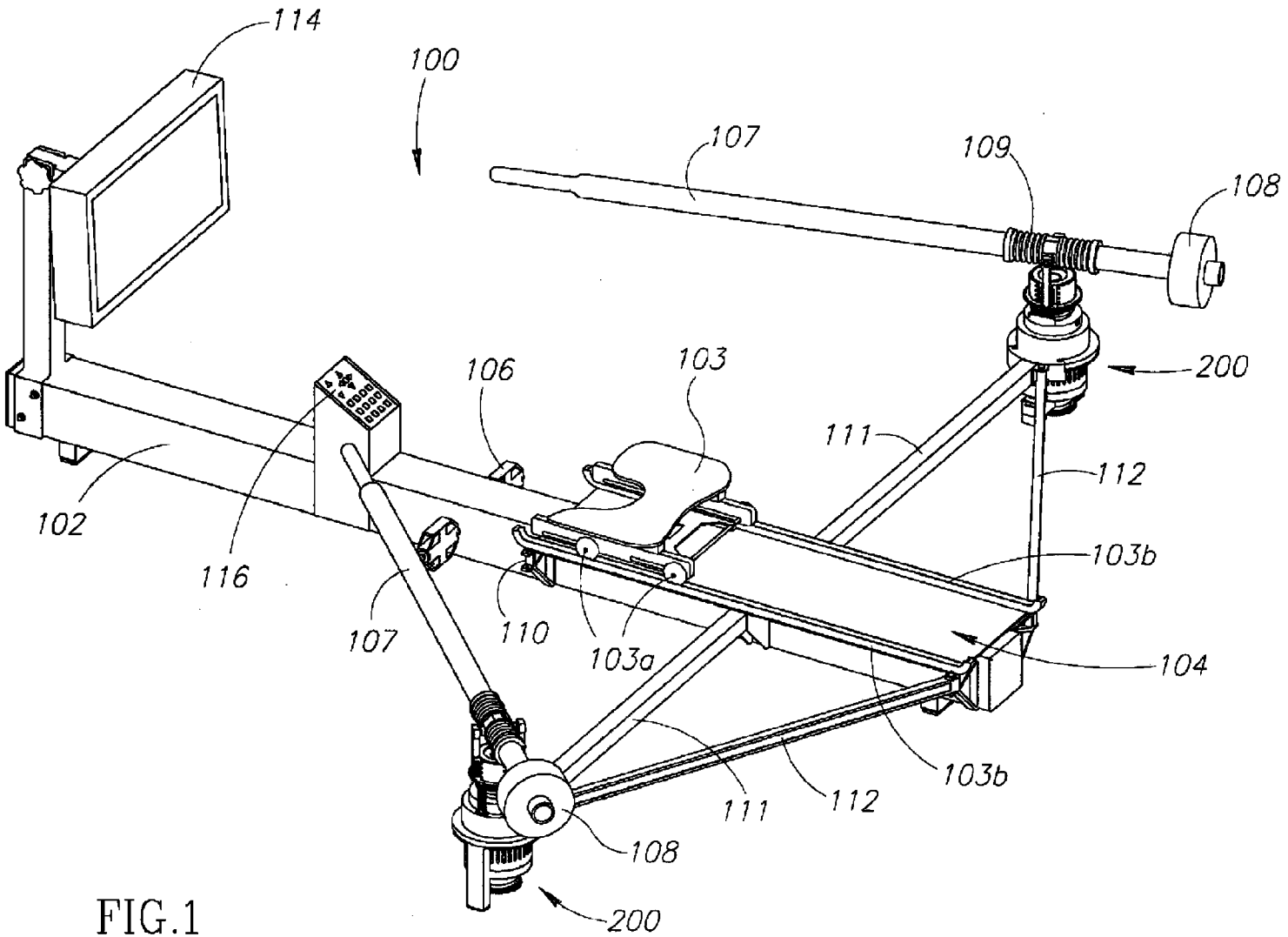
FIG. 1 is a perspective view of an apparatus in accordance with the disclosed subject matter.

FIG. 1 shows the apparatus 100 of the disclosed subject matter. The apparatus 100 is shown, for example, as a sculling or rowing training machine. The apparatus 100 includes a longitudinal support beam 102, over which a seat 103 rolls. The seat 103 includes wheels 103*a* on both sides of the support beam 102, that ride on parallel runners 103*b*. The runners 103*b* are disposed on opposite sides of the support beam 102, on a support plate 104. The runners 103*b* are curved upward at their ends, to define the extent of travel for the wheels 103*a*, and accordingly, limit travel of the seat 103. Foot pedals 106 extend from the sides of the longitudinal support 102. These foot pedals 106 allow the user to brace his feet during operation.

Oars 107 are received by drive assemblies or actuators 200 in gimbal supports 201. Each oar 107 includes a counterweight 108, that is positioned on the respective oar 107, for example, in a fixed engagement. The counterweights 108 balance and inertially simulate the mass properties of a true oar. The oars 107 are maintained in a null position by a parallel arrangement of return springs 109. The drive assemblies 200 are maintained in position by transverse support arms 111 and diagonal support arms 112, both extending from the longitudinal support 102.

Figure 11:
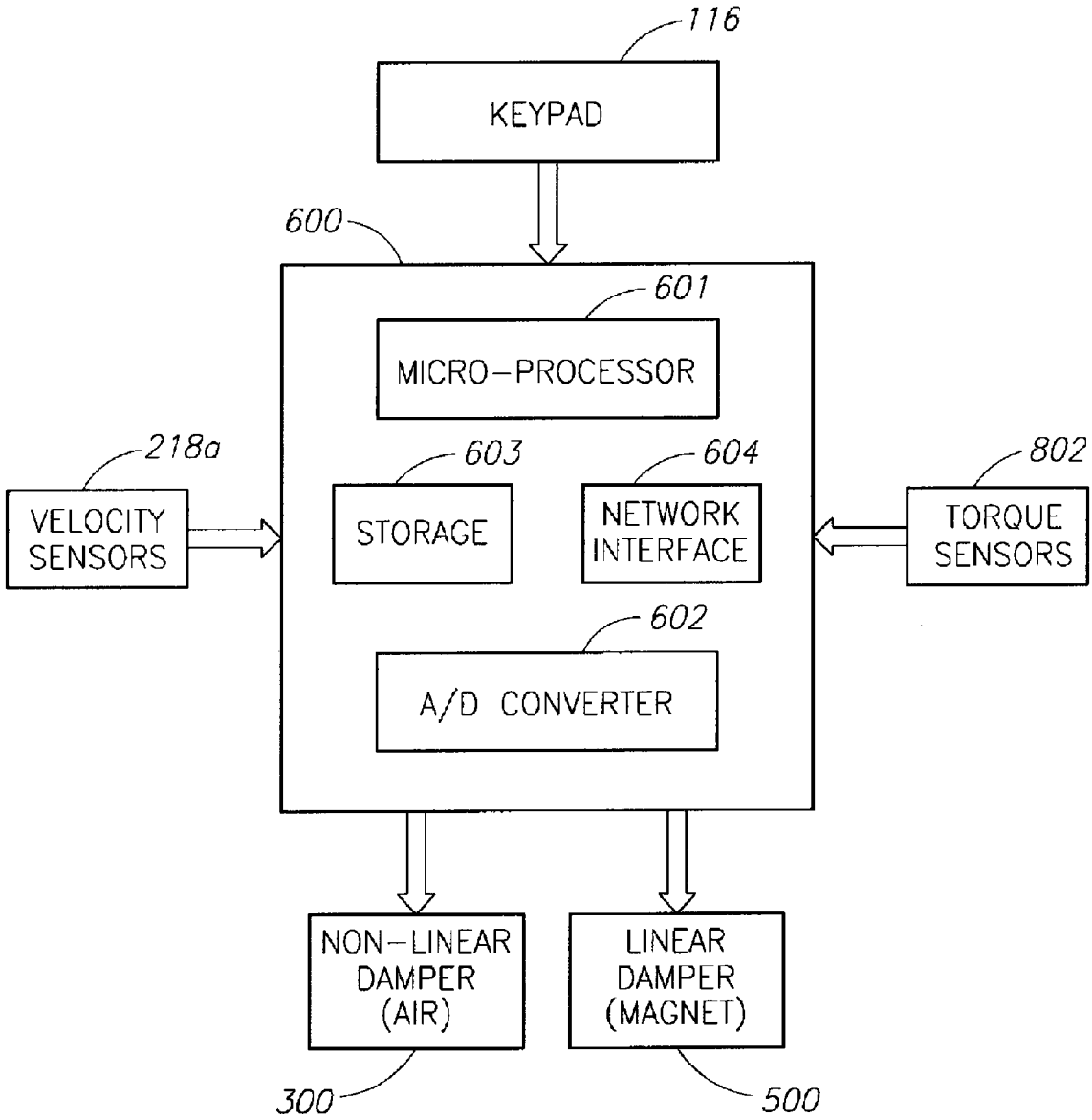
FIG. 11 is a block diagram of the computer system of the apparatus.

A computer display 114, such as a monitor, is electronically linked, by wired or wireless links, or combinations thereof, to a computer 600, with a processor (for example, a conventional microprocessor) 601 and an A/D (analog to digital) converter 602, shown diagramatically in FIG. 11, housed in the longitudinal support 102. In this document, "electronically linked" means electronic and/or data connections by wired or wireless links or combinations thereof. The computer 600 is also electronically linked to the damping (or damper) assemblies, a non-linear or air damper 300, and a linear or magnetic damper 500, as well as a keypad 116, through which the user inputs data, as shown diagramatically in FIG. 11.

Figure 2:
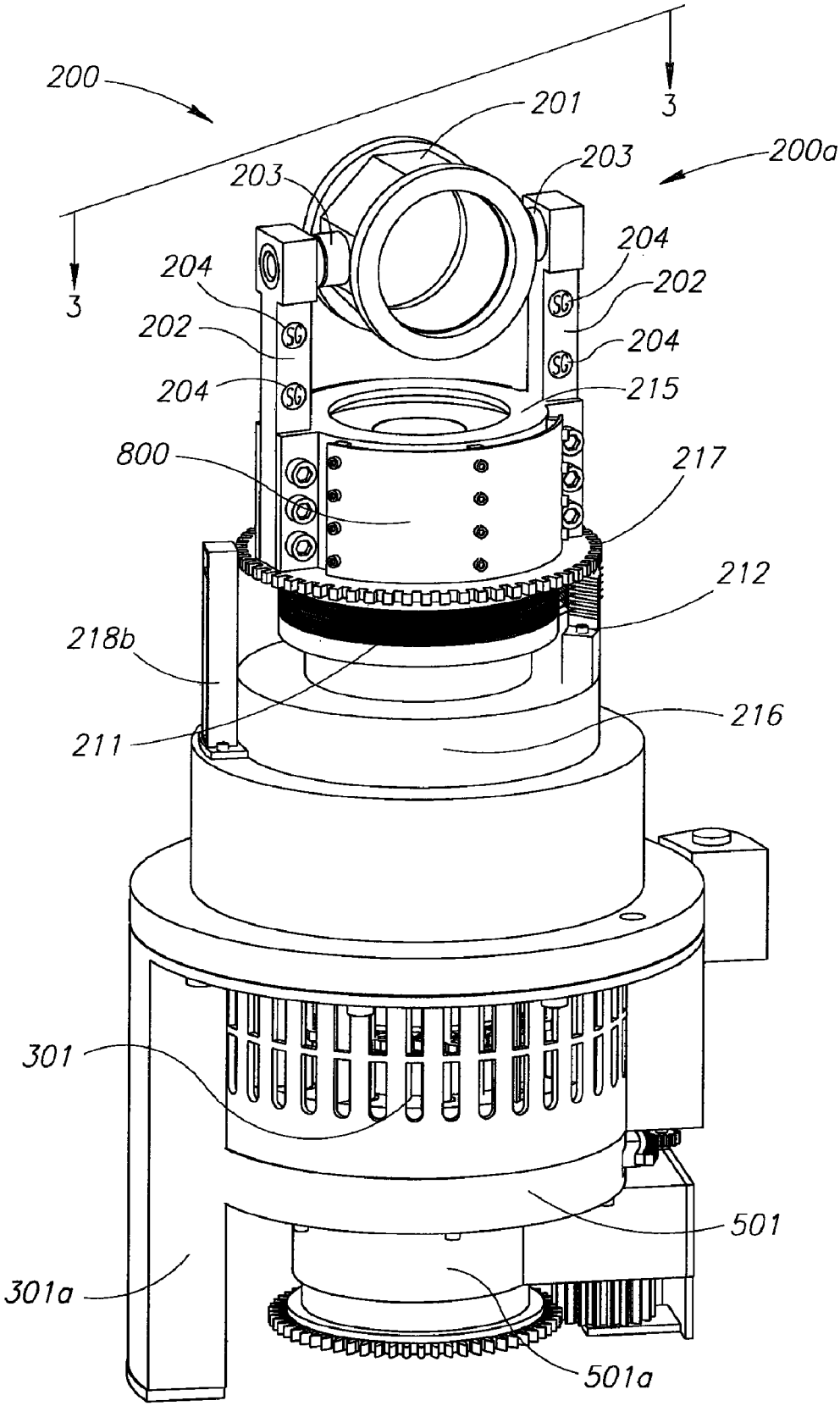
FIG. 2 is a perspective view of the drive assembly of the apparatus if FIG. 1.
Figure 3:
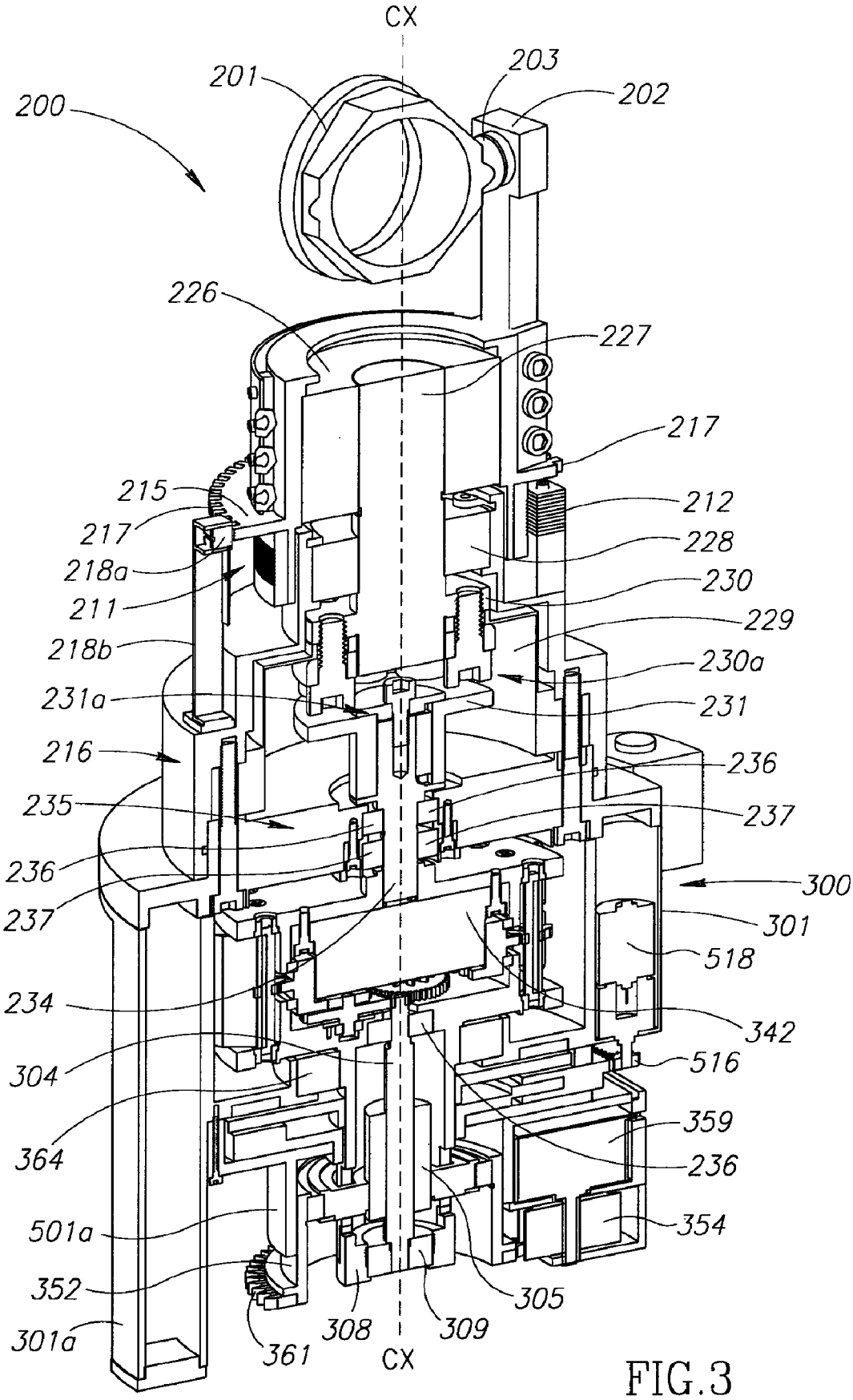
FIG. 3 is a cross sectional view of a drive assembly of the apparatus of FIG. 1, taken along line 3-3 of FIG. 2.
Figure 4:
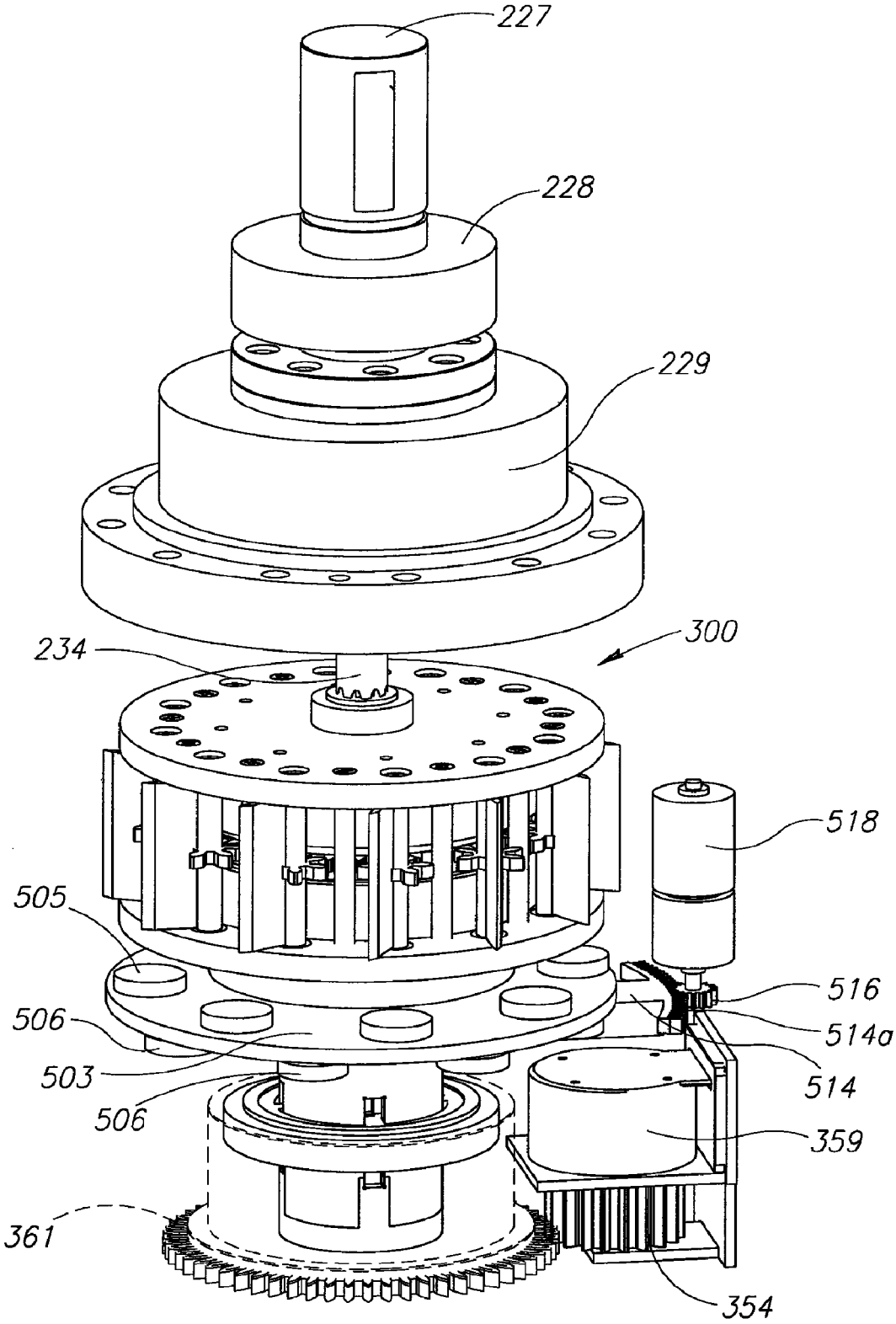
FIG. 4 is a perspective view of the transmission and damper assemblies within the drive assembly.
Figure 5:
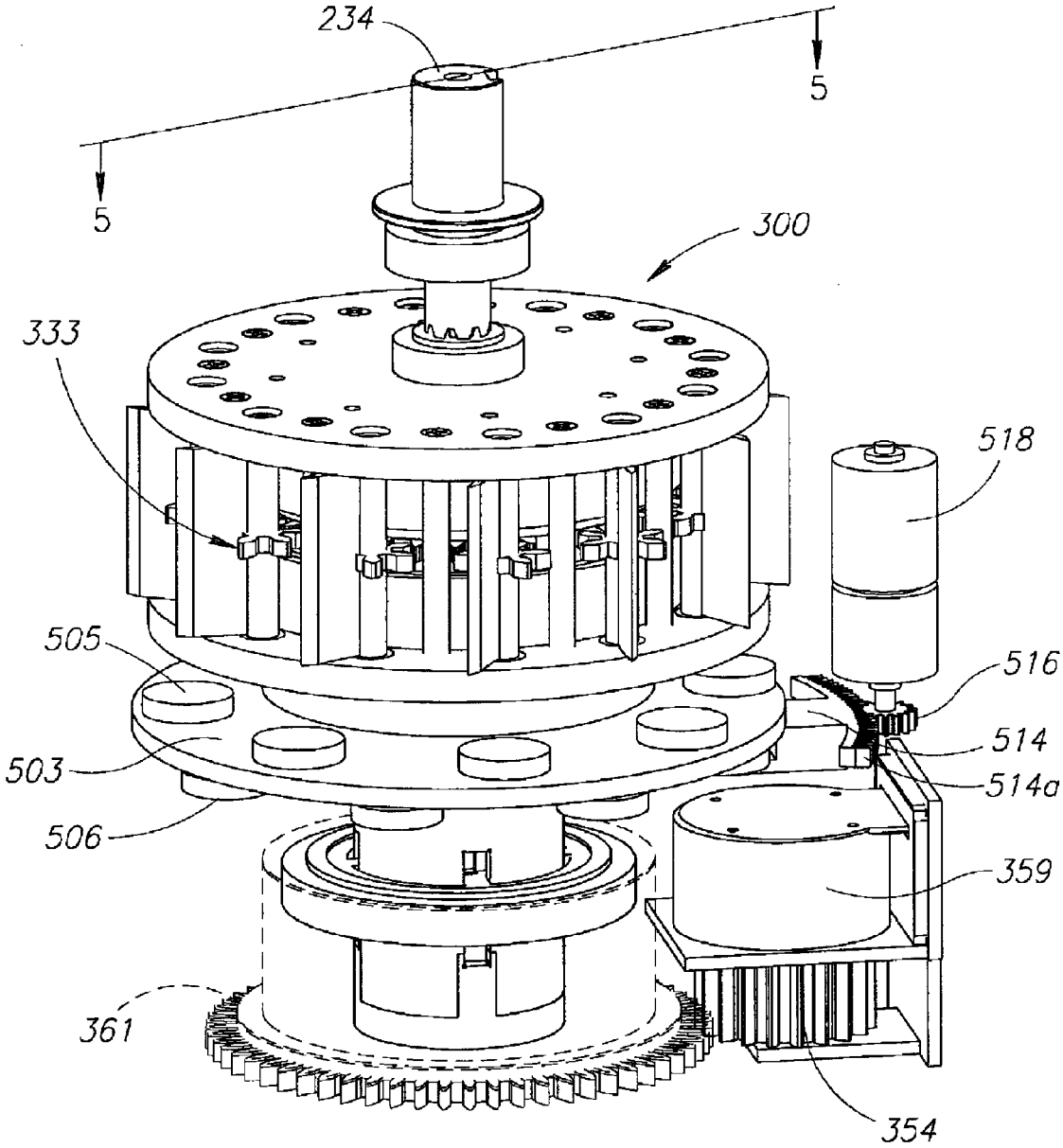
FIG. 5 is a perspective view of the damper assemblies within the drive assembly.
Figure 6:
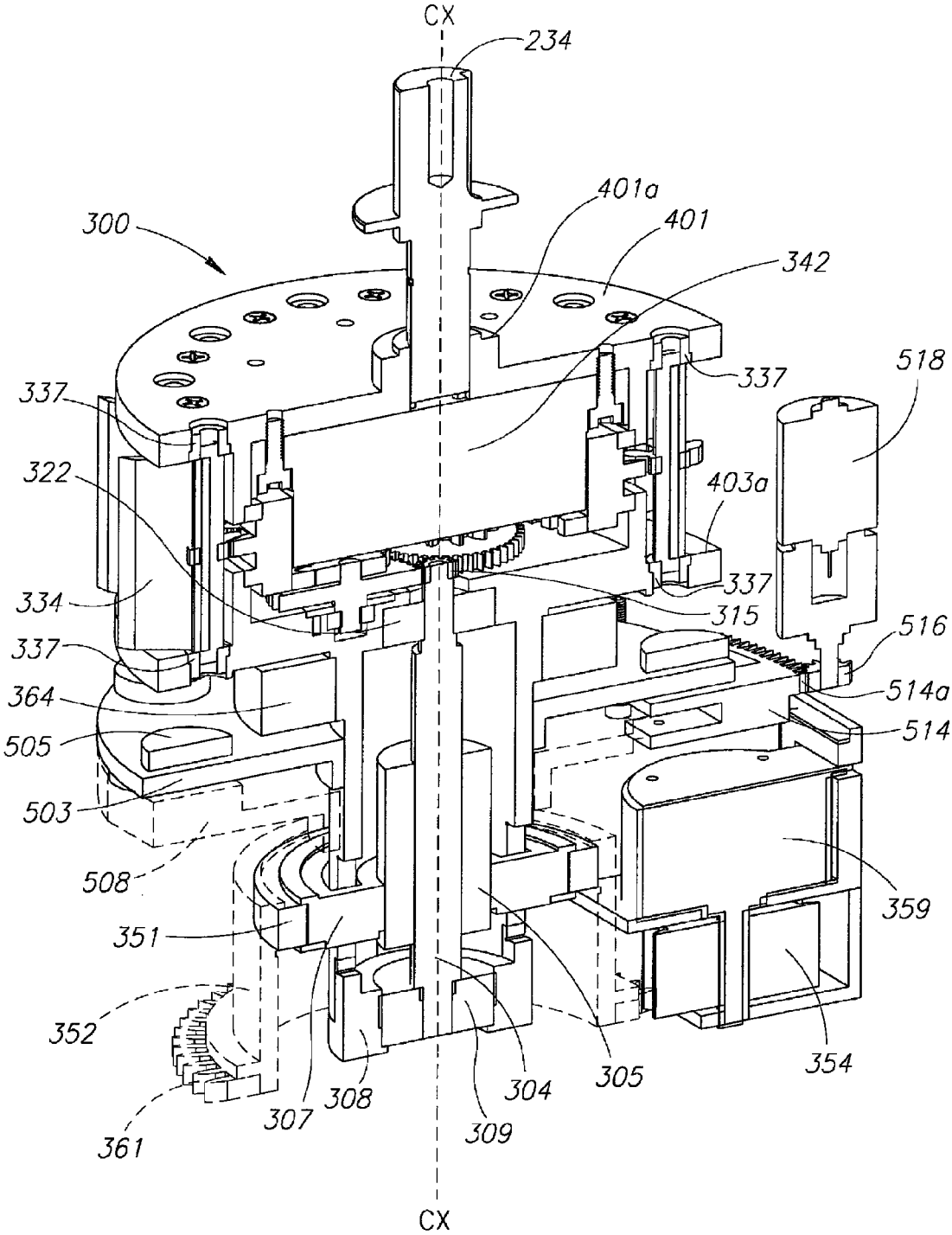
FIG. 6 is a cross sectional view of the damper assemblies of FIG. 5, as taken along line 5-5 of FIG. 5.
Figure 7:
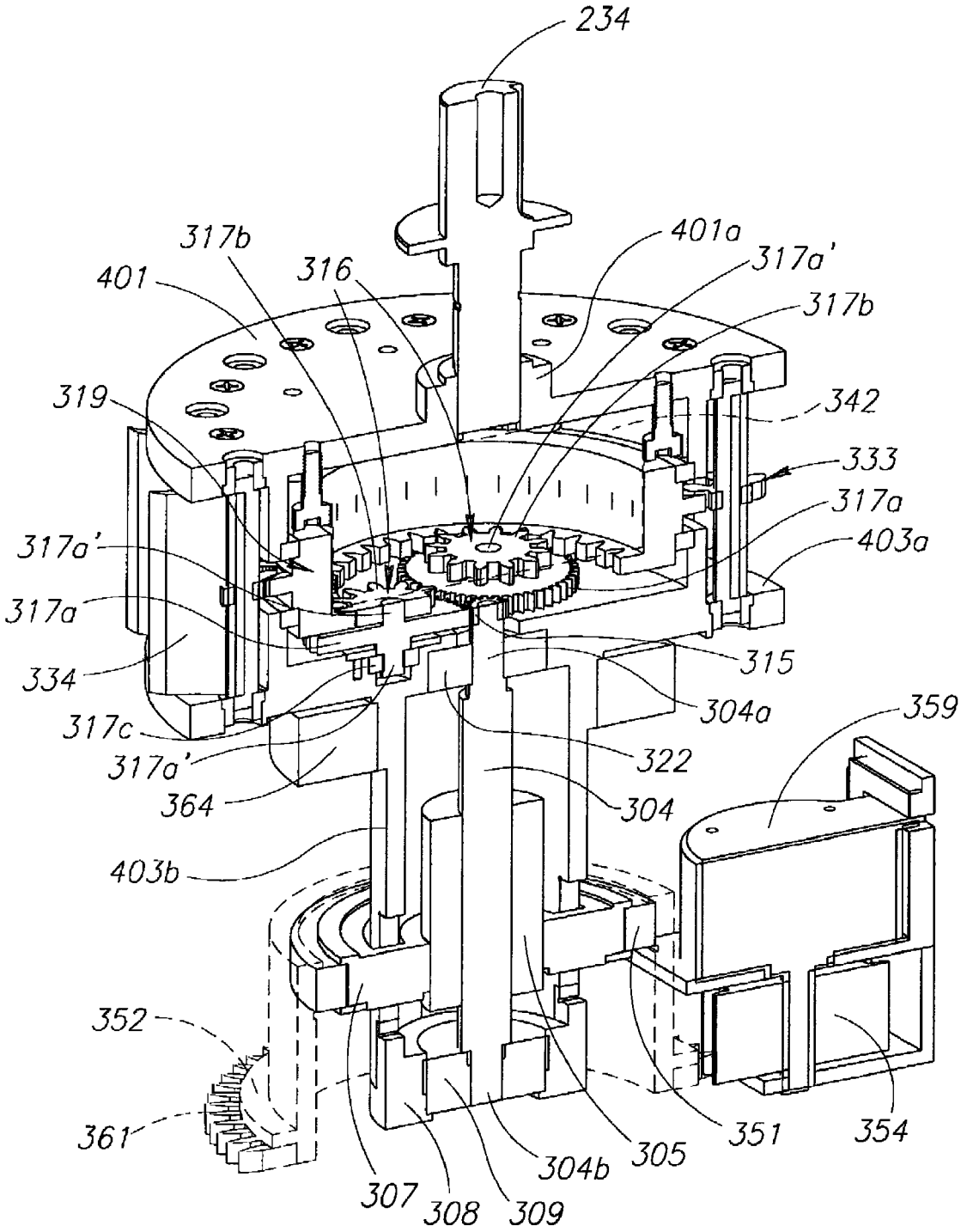
FIG. 7 is a cross sectional view of the nonlinear damper assembly of FIG. 5, as taken along line 5-5 of FIG. 5.
Figure 8:
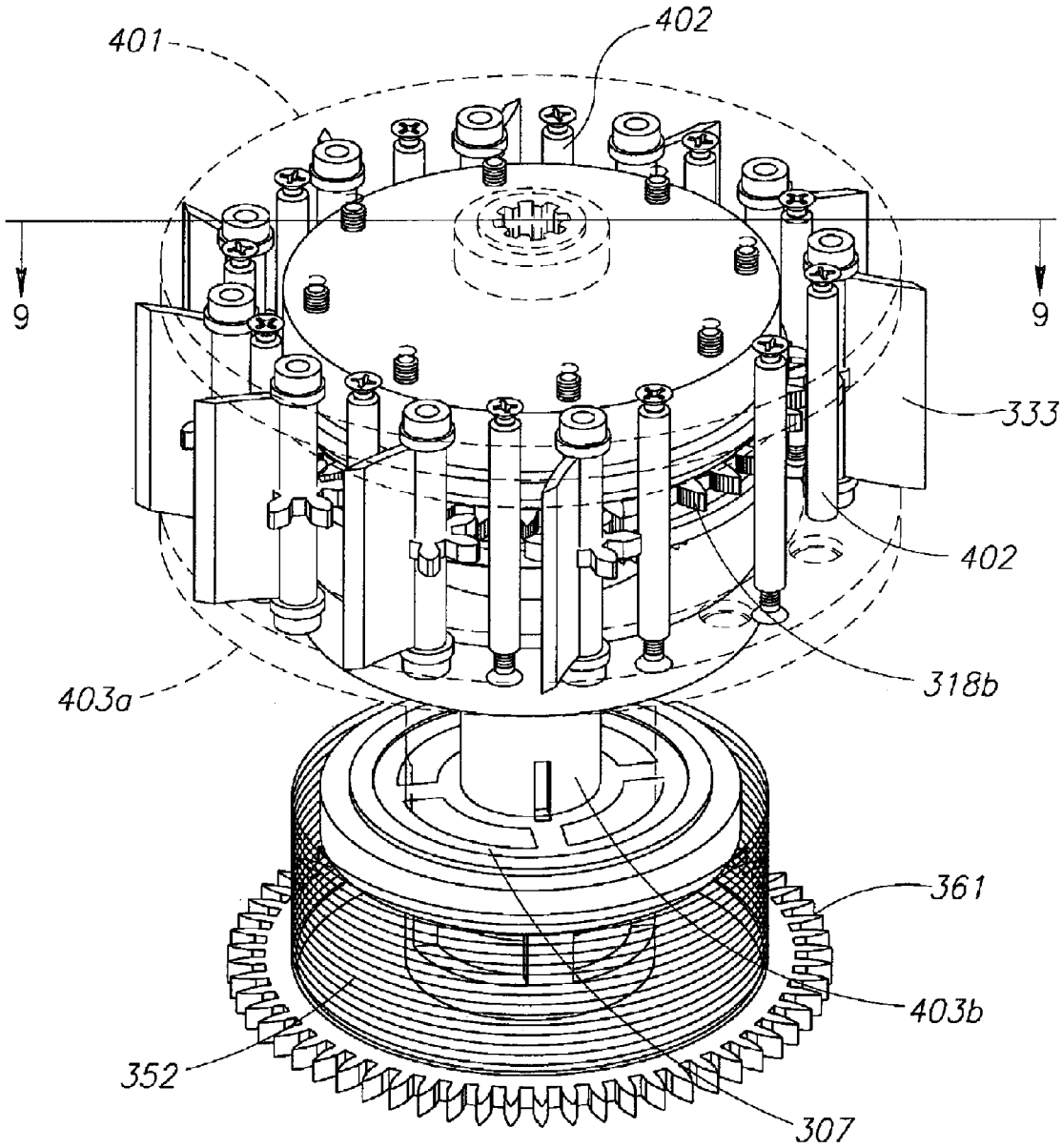
FIG. 8 is a perspective view of the of the non-linear damper assembly of the apparatus.

Attention is now directed also to FIGS. 2 and 3, to detail the drive assemblies or actuators 200. While only one drive assembly 200 is shown, this drive assembly 200 is representative of both drive assemblies, as the other drive assembly 200 is symmetric and otherwise identical. Additionally, the components of the drive assemblies 200 detailed below may be joined connected or the like by various mechanical adhesive fasteners, such as screws, bolts, seals and the like, that may not be mentioned specifically, but whose use is well known to one of skill in the art.

The input end 200*a* of the drive assembly 200 includes the oar gimbal support 201, that is, for example, cylindrical or of another shape sufficient to receive a correspondingly shaped oar 107. The oar gimbal support 201 is typically pivotally mounted on a gimbal support post 202, with bushings 203, for example, of Teflon®, therebetween. Strain gages (SG) 204 form the variable resistive component of a bridge circuit (detailed below). A set of strain gages 204 are integrated into each gimbal support post 202. The remainder of the bridge circuitry, along with voltage amplification circuitry (not shown) are located on a circuit board 800. The torque sensor 802 is the assemblage of components encompassing the support posts 202, strain gages 204, bridge and amplifier circuits.

The torque sensor 802 is electronically linked to the computer 600, as shown in FIG. 11, via a the slip ring 211/brush block 212 interface. The slip ring 211 is mounted on a clutch housing 215. The brush block 212 is mounted on the drive assembly housing 216. The clutch housing 215 terminates in a cog wheel 217. Angular velocity sensor 218*a*, for example, a conventional chip, such as an Allegretto ATS651LSH, is mounted within the angular velocity sensor support post 218*b*. The support post 218*b* is in turn mounted on the drive assembly housing 216. The angular velocity sensor 218*a* is electromagnetically coupled to the cog wheel 217.

The clutch housing 215 supports the gimbal support posts 202, and encases a clutch 226, that is coaxial with, and surrounds, an input drive shaft 227. The clutch 226 and input drive shaft 227 rotate about a central axis CX. The clutch 226 is designed to allow actuation in only one (a single) rotational direction. The input drive shaft 227 extends downward through a ball bearing 228.

Within the drive assembly housing 216, the input drive shaft 227 is rigidly coupled to input 229*a* of the harmonic drive 229 at the flex spline input coupling flange 230, with associated fastening mechanisms 230*a*. Also, within the housing 216, the proximal end of the splined output drive shaft 234 (that rotates about the central axis CX and is coaxial with the input drive shaft 227) is rigidly mounted to the output 229*b* of the harmonic drive 229 at the wave generator output coupling flange 231, also with associated fastening mechanisms 231*a*. The harmonic drive 229 couples to the variable non-linear damper 300 via the splined output drive shaft 234.

The drive assembly housing 216 is coupled to the damper housing 301 by an intermediate flange 235. The damper housing 301 includes air vents where the damping medium of the non-linear damper is air. However, the damper housing 301 may be sealed if the damping medium for the non-linear damper is a liquid. The damper housing 301 also includes vertical support posts 301*a* and encloses the components that form the non-linear damper 301. The splined output drive shaft 234 is supported at the flange 235 by a ball bearing 236 and a seal 237, for example, an elastomeric O-ring, labyrinth seal, or the like.

Figure 9:
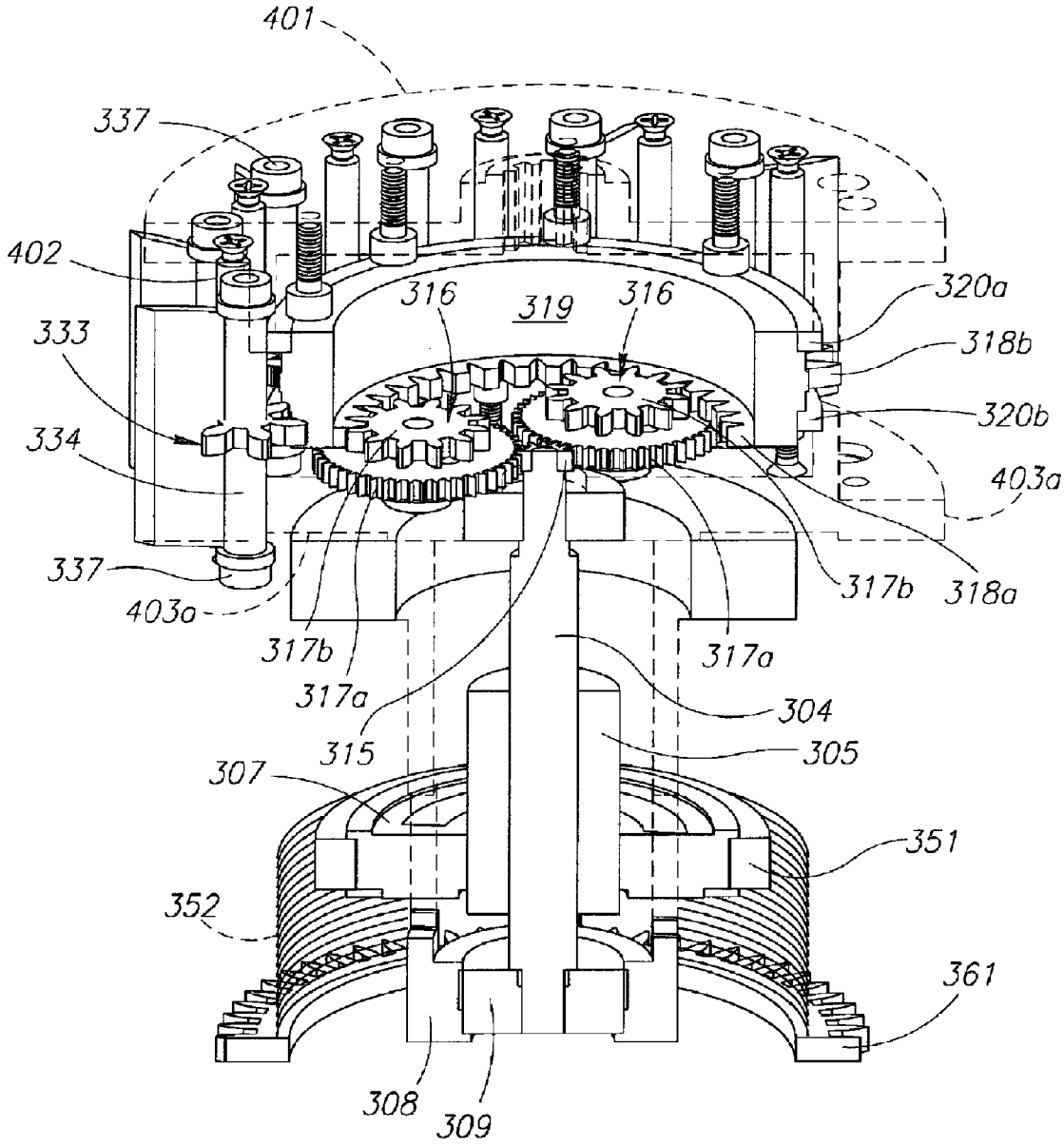
FIG. 9 is a cross sectional view of the non-linear damper assembly taken along line 9-9 of FIG. 8.

Attention is now also directed to FIGS. 4-9, that show the non-linear damper (damping assembly or mechanism) 300 in detail. The splined output drive shaft 234 is torsionally coupled to the torque transfer housing assembly 400 at the proximal support plate 401, by a female splined coupling interface 401*a*. The proximal support plate 401 in turn, is rigidly coupled to the distal support plate 403*a*/torque transfer cylinder 403*b* by the multiple support struts 402. The torque transfer cylinder 403*b* encloses a ball screw 304 (that rotates about the central axis CX), ball nut 305, the internally radiating spokes of a spoked ball nut support ring 307, and an end support cap 308 that houses a ball bearing 309. The ball screw 304 is supported at one end (proximal end) 304*a* by the ball bearing 322, encased in the distal support plate 403*a*, and at the other (distal) end 304*b* by the ball bearing 309, supported within the end support cap 308. The first (proximal) end 304*a* of the ball screw 314 has a pinion gear 315 mounted on it. The pinion gear 315 meshes with a triad of radial gears 316 (only two radial gears 316 are shown in FIG. 9). Each radial gear 316 is formed of coaxial gears 317*a* (lower or distal), 317*b* (upper or proximal).

The lower or distal coaxial gear 317*a* meshes with the pinion gear 315. This gear 317*a* includes an integrated axle 317*a*', an upper or proximal portion that extends through the upper or proximal coaxial gear 317*b*. The other, lower or distal portion is received in the distal support plate 403*a* and is mounted with ball beatings 317*c*.

The upper or proximal coaxial gear 317*b* meshes with an internal gear 318*a*, that is integrated into a hollow short aspect axle 319 at its internal cylindrical face. An external gear 318*b* is integrated into the short aspect axle 319 at its external cylindrical face. The short aspect axle 319 is supported proximally and distally by low profile ball bearings 320*a* and 320*b* respectively.

Low profile ball bearings 320*a* (positioned proximally with respect to the other low profile ball bearings 320*b*) are supported proximally by the support plate 401, and distally by the short aspect axle 319. The distal low profile bearing(s) 320*b* is supported proximally by the short aspect axle 319 and distally by the support plate 403*a*.

The external gear 318*b* meshes with a series of multiple circumferentially positioned sector pinion gears 333. Each sector pinion gear 333 is mounted centrally within the vane-axle-gear assembly 334. For example, gearing from the pinion gear 315 to the sector pinion gears is at a ratio of approximately 3:1 reduction. The multiple vane-axle-gear assemblies 334 are supported at the periphery of the non-linear damper 300 by the proximal support plate 401, distal support plate 403*a*, and their respective sets of support bushings 337. A flywheel 342 is rigidly mounted to the proximal support plate 401.

A spoked ball nut mount ring 307 is supported at its internal cylindrical face by the ball nut 305, and at its external cylindrical face by a ball bearing 351. The spoked ball nut mount ring 307 is allowed to translate axially along the slots of the of the torque transfer cylinder 403*b*. Torque transferred to the spoked ball nut mount ring 307 from the torque transfer cylinder 403*b* is due to contact between the ring 346 and cylinder 403*b* at the slot interface.

Ball bearing 351 is mounted on an externally threaded ball bearing support cylinder 352. The externally threaded outer support cylinder 352 is in turn, coupled to the internally threaded cylindrical portion of the linear damper housing cover 501*a* (FIG. 3). The externally threaded ball bearing support cylinder 352 is also coupled to a pinion gear 354 mounted on a stepper motor 359 via integrated spur gear 361. The stepper motor 359 is also electronically linked to the computer 600.

A magnetic damping wheel 503 of the linear or magnetic damper 500, for example, a variable linear or magnetic damper, is rigidly supported on the torque transfer cylinder 403*b*. The torque transfer cylinder 403*b* is supported by a ball bearing 364 on the non-linear damper housing 301 (FIGS. 2 and 3).

Figure 10:
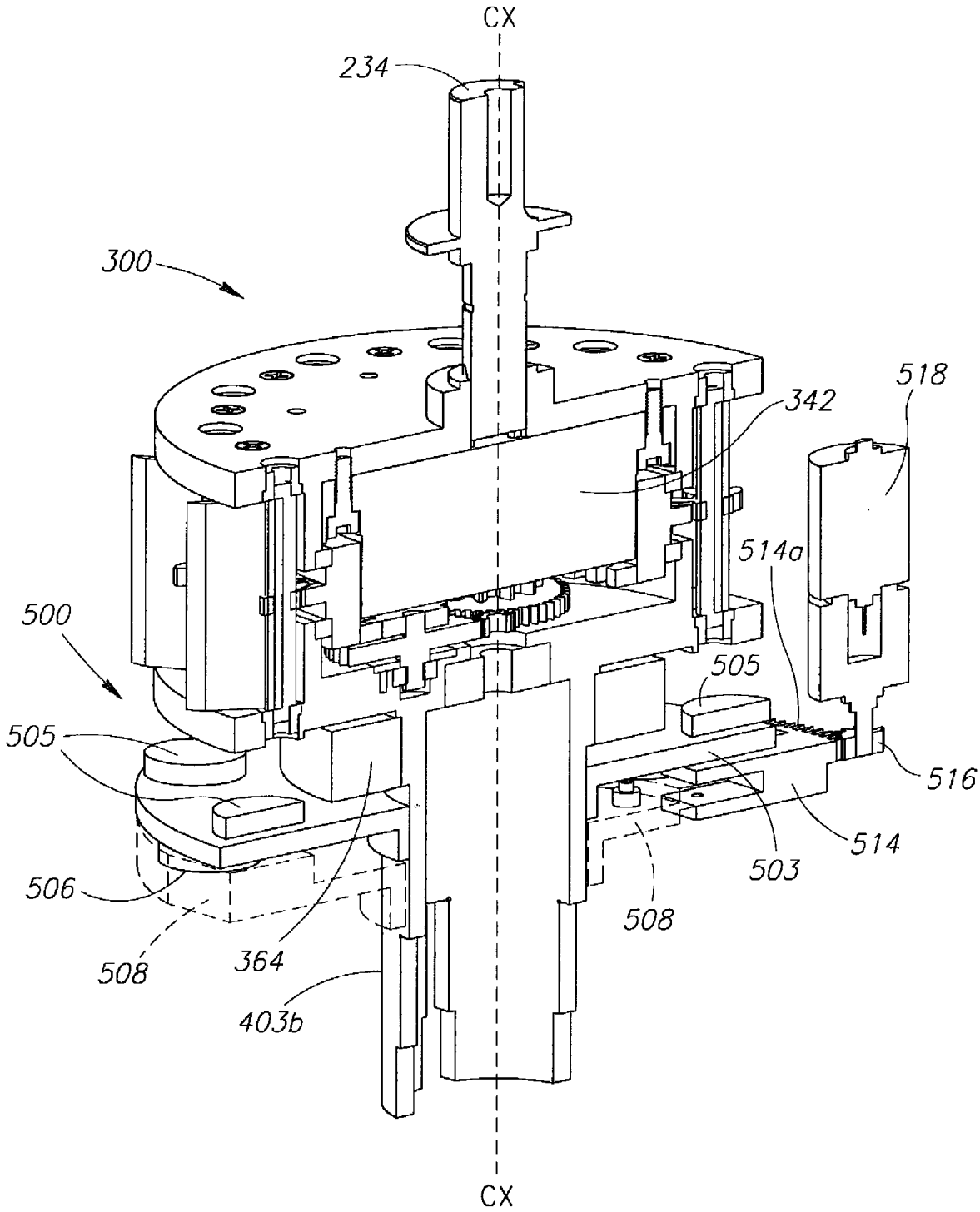
FIG. 10 is a cross sectional view of the linear damper assembly of FIG. 5, as taken along line 5-5 of FIG. 5.

Turning also to FIG. 10, that illustrates the linear or magnetic damper (damping apparatus or assembly) 500, in detail, there is a series (set) of circumferentially positioned proximal magnets 505, that is supported at the distal external face of the damper housing 301 (FIG. 2). A series (set) of distal magnets 506 is located on the magnet support plate 508. The distal magnet support plate 508 is such that it rotates about the central axis (CX), while being confined radially and axially by the linear damping housing cover 501 (FIG. 2).

A sector spur gear 514 is mounted on the distal magnet support plate 508. The sector spur gear 514, includes gear teeth at its edge 514*a*, that mesh with a pinion gear 516 of a stepper motor 518. The stepper motor 518 is also electronically linked to the computer 600. The magnetic damping wheel 503 is positioned in between the set of proximal 505 and distal 506 magnets. The linear damper housing cover 501 has a central opening (not shown) that allows the torque transfer cylinder 403*b* unrestrained access through its center.

Attention is now directed to FIGS. 1-11, to illustrate an exemplary operation of the apparatus 100, and in particular, the operation of the drive assemblies or actuators 200. When force is applied to an oar 107, a twisting moment or torque is generated and transmitted to the respective input drive shaft 227. The counterweights 108 on each oar 107 simulate the inertial properties of the suspended mass of an oar. The level of torque applied to the drive assembly 200, as well as its rotational velocity, is a function of the impedance created by the inertial and damping elements of the drive assembly 200, and the force that the user provides at the oar 107.

Linear damping is provided by the linear or magnetic dampers 500 that are under computer 600 control (FIG. 11). Non-linear damping, for example, square law damping, is provided by the non-linear dampers 300, detailed above, that are also known as air, fluid or viscous dampers. The non-linear dampers 300 are also under computer 600 control (FIG. 11).

Figure 12:
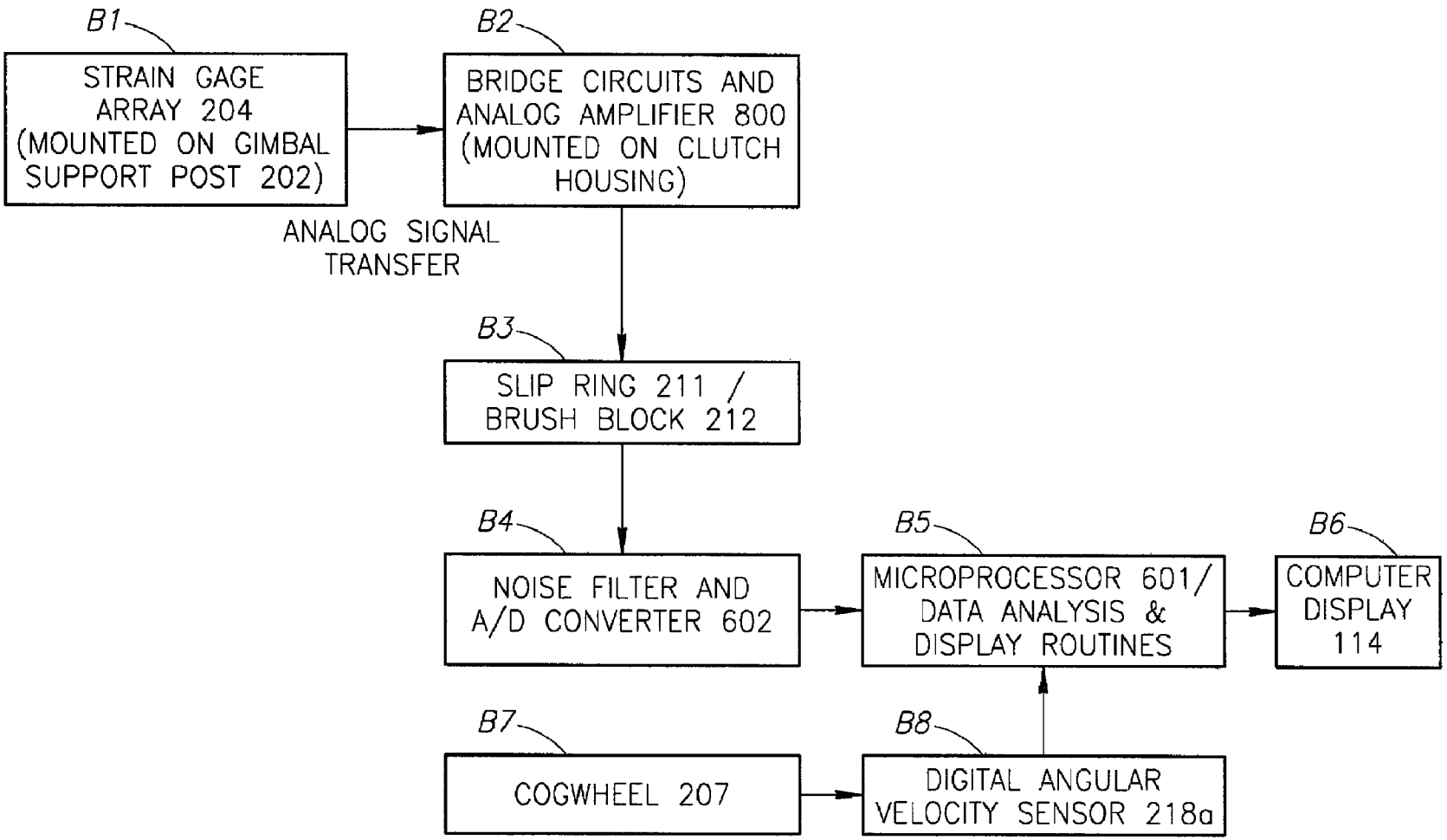
FIG. 12 is a is a flow diagram for the angular velocity and torque sensing.

Turning now to also to FIG. 12, a flow chart detailing a process for obtaining torque and velocity data is illustrated. Initially, at block B1, a change in resistance of the strain gage (SG) 204 caused by deflection of the gimbal support posts 202 causes a change in bridge circuit output that is in turn amplified by the analog amplifier mounted on the circuit board 800, at block B2. The circuit boards 800 are mounted on the clutch housings 205 of their respective actuators 200. The amplifier output voltage is then routed via the slip ring 211/brush block 212 electrical interface, at block B3 to the noise filter and analog to digital converter circuits 602 of the computer 600, at block B4. This converted signal will then be used by the data analysis computer programs contained within the storage 603 or non-volatile memory of the processor, for example, a microprocessor 601, to convert the data into real time input torque data, at block B5.

At block B7, motion of the cog wheel 205 is sensed by the digital angular velocity sensor 218*a*. The digital angular velocity sensor 218*a* converts this motion into a digital signal, at block B8, and sends it to the computer 600, at block B5. This digital signal will then be used by the data analysis computer programs contained within the storage 603 and the non-volatile memory of the microprocessor 601, at block B5, to convert the data into real time input velocity data.

The microprocessor 601 at block B5, executes the appropriate data conversion and analysis routines and displays the output data in the user selected format on the display monitor 114 (B6). The keypad 116 allows the user to select from a menu the program that will display the data.

Figure 13:
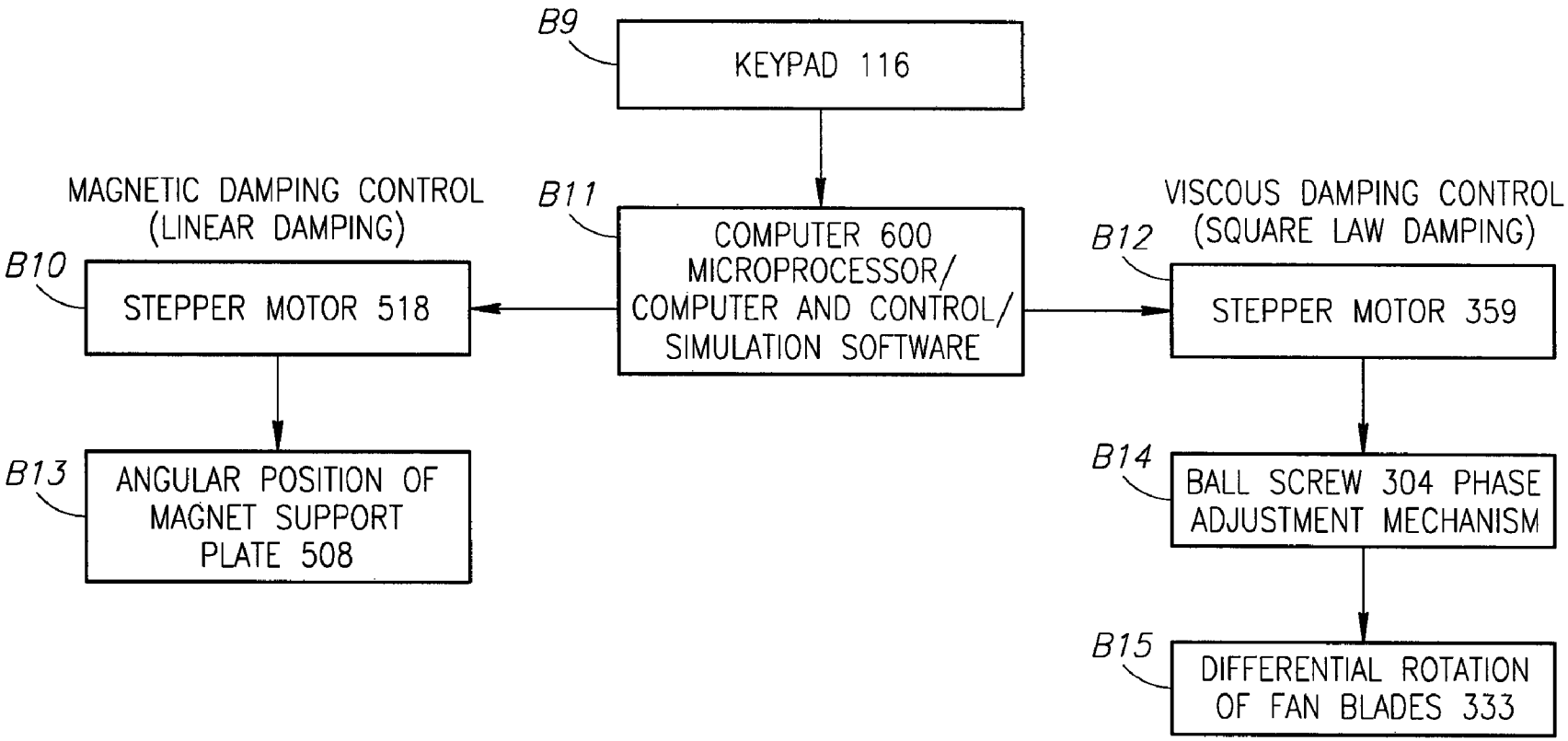
FIG. 13 is a flow diagram of the linear and non-linear damping adjustment and control.

Turning also to FIG. 13, a flow chart detailing a process for varying the non-linear damping and linear damping is illustrated. Changes in linear or non-linear damping are typically performed under computer control, through algorithms, such as those detailed below, or the like, but may also be manual. This automatic or manual control requires interfacing with the computer 600 via the keypad 116. Specific sculling (rowing) routines can be selected via the keypad 116. Alternately, if the user wishes to use the machine without executing a preprogrammed routine, changes to the damping levels can be made via the keypad 116, such that the stepper motors 359 and 516 will be set to predetermined operating conditions (rotations). Still alternately, the stepper motors 359, 516 can also be set to default settings (rotations), such that computer 600 interaction is not necessary.

Initially, a rowing routine is selected from a menu of preprogrammed routines via the keypad 116, at block B9. During execution of a rowing program, subroutines contained within the program, typically held in the storage 603 (FIG. 11), will dynamically alter the linear and non-linear damping to create a dynamic change in input impedance, as seen from input drive shaft 227, at block B11. This is then realized by the user as change in load condition at the oar that will require a change in physical output by the user to effect a desired torque output, velocity output or energy expenditure.

Linear damping is a linear function of the rotational velocity of the output drive shaft 234. Linear damping is, for example, in the form of magnetic damping and is varied when the computer 600 sends a signal to the stepper motor 518 to increment its rotation, at block B10. Rotation of the stepper motor 518 causes rotation of the pinion gear 516 attached to it. Rotation of the pinion gear 516 rotates the sector spur gear 514 attached to the magnet support plate 508. This is turn causes rotation of the magnet support plate 508. Rotation of the magnet support plate 508 causes a rotational shift in the distal set of magnets 506 mounted on the magnetic wheel 503, with respect to the proximal set of magnets 505, about the axial center CX of the drive assembly 200. This is reflected at block B13 as a change in angular position of the magnet support plate 508.

This in turn alters the magnetic field created between the opposing proximal 505 and distal 506 sets of magnets. Hence, altering the position of one set of magnets or the flux density of the magnets changes magnetic or linear damping by altering the way the induced back voltage in the magnetic damping wheel 503 interacts with the magnetic flux lines.

The flux density of the magnets can be fixed with the use of permanent magnets or can be varied with the use of electromagnets. The amount of magnet support plate 508 rotation needed to effect a specific amount of linear damping is preprogrammed and contained within the computer control routines.

Non-linear damping is a square law function of the rotational velocity of the output drive shaft 234. Non-linear damping is in the form of air or fluid viscous drag and is varied when the computer 600 sends a signal to the stepper motor 359 to increment its rotation, at block B12. This causes a ball screw 304 phase adjustment, at block B14, that causes movements resulting in differential rotations of the fan blades 334, in block B15. The processes of blocks B12, B14 and B15 occur as follows.

Incremental rotation of the stepper motor 359 causes incremental rotation of the pinion gear 354 attached to it. This in turn causes incremental rotation of the sector spur gear 361 attached to the externally threaded ball bearing support cylinder outer support ring 352. Incremental rotation of the externally threaded ball bearing support cylinder outer support ring 352 causes an incremental axial translation of the ring 352. This is a result of its screw interface with the internally threaded portion of the linear damper housing cover 501*a*. Incremental translation of the outer support ring 352 causes an incremental axial translation of the ball bearing 351 supporting the ball nut spoke ring 346. Incremental translation of the ball bearing 351 causes an incremental axial translation of the spoke ring 307. Incremental translation of the spoke ring 305 results in incremental axial translations of the ball nut 305.

Incremental translation of the ball nut 305 causes an incremental rotation of the ball screw 304 beyond that imparted to it by its own rotational velocity. High velocity rotations of the ball screw 304 is a result of the interfacial coupling between the torque transfer cylinder 403*b* of the non-linear damper 300 and the spokes of the ball nut spoke ring 307. The incremental rotation of the ball screw 304 then causes and incremental rotation of the pinion gear 315. The incremental rotation of the pinion gear 315 causes an incremental rotation of the triad of radially oriented gears 316, resulting in a corresponding incremental rotation of the coaxial gears 317*a*, 317*b*. The incremental rotation of the coaxial gears 317*a*, 317*b* translates to the internal gear 318*a*, causing a corresponding incremental rotation of the short aspect hollow axle 319. Incremental rotation of the short aspect hollow axle 319, and accordingly, the external gear 318*b*. The incremental rotation of the external gear 318*b* causes an incremental rotation of the planetary sector pinion gear 333 mounted within the vane-axle-gear assembly 334. In effect, translation of the ball nut 305 creates a phase difference in rotation between the vane-axle-gear assemblies 334 and the torque transfer housing 400. The epicyclic gear train described above is incorporated to match the ball screw 304 displacement to vane rotation range of motion. The amount of axial translation necessary to effect a specific amount of vane rotation for a specific amount of non-linear damping is pre-programmed and contained within the computer control routines.

As a result, the damping load is adjusted in both the non-linear 300 and linear 500 dampers, and transferred to the output drive shaft 234, to simulate damping (on an oar) caused by water. This can be further augmented by the computer programs, as detailed herein, that can further account for the velocity of the water, slow moving, fast moving, still, or the like.

Figure 14:
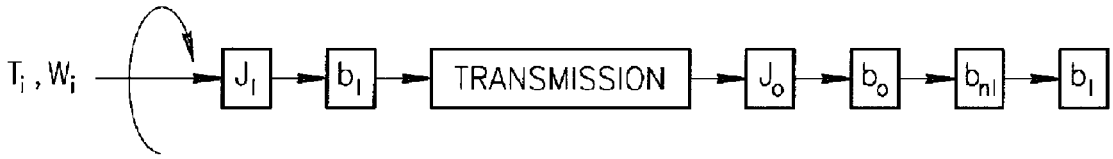
FIG. 14 is a schematic block diagram of the torque and velocity load path for the drive assembly and its major components in accordance with the disclosed subject matter.

The mathematical relations describing the basis for the apparatus 100, with its drive assemblies or actuators 200 (also referred to as transmissions), that incorporate inertial and linear and non-linear damping elements, will now be described. Given a one stage mechanical transmission with defined properties of input and output rotational inertia, output linear and non-linear damping, the equation relating input drive torque to angular velocity and accelerations is expressed by the following equation:

$$T_i=(J_i+N^2\cdot J_o)\cdot w_{iaa}+((b_i+N^2\cdot(b_o+b_l))\cdot w_i+b_{nl}\cdot N^3\cdot w_i^2$$

where:

$T_i$=input torque applied to the transmission $J_i$=rotational inertia at the input side of the transmission $J_o$=rotational inertia at the output side of the transmission N=transmission multiplying factor or gear factor $w_i$=angular velocity at the input side of the transmission $w_{iaa}$=angular acceleration at the input side of the transmission $b_i$=drag coefficient at the input side of the transmission $b_o$=drag coefficient at the output side of the transmission $b_l$=linear damping coefficient at the output side of the transmission $b_{nl}$=non-linear damping coefficient at the output side of the transmission A schematic outline of the load path for the above formulation is shown in FIG. 14. Based on the equation above, the input torque level, required to obtain or maintain a given input velocity, is sensitive to variations in output damping levels. By sensitive, it is meant that small changes in linear or non-linear damping will require large changes in input torque to maintain a desired input velocity level. Accordingly, the apparatus 100 is such that fine control of damping parameters forces large changes in energy expenditure by the user in order to maintain a constant rowing velocity.

Returning back to the equation previously defined, for example, design parameters may be selected representing the various equation variables, as follows:

input inertia, $J_i$, is represented by the combined inertia of the oar 107 and its counterweight 109 and all other components that rotate at the same velocity with each stoke of the oar at the input end of the transmission 200;

output inertia, $J_o$, is represented by the combined rotational inertias of the harmonic drive 229 , output drive shaft 234, non-linear viscous damper assembly 300 including ball screw 304 and ball nut 305, magnetic damping wheel 503, and all other components that rotate at the same velocity as the output end of the harmonic drive 229;

linear, $n_l$, and non-linear, $n_{nl}$, damping, are represented by the variable linear magnetic 500 and variable non-linear fluid viscous 300 dampers respectively;

transmission multiplying factor, N, is represented by the harmonic drive gear ratio.

The apparatus 100 incorporates routines (including algorithms) within its storage 603 and non-volatile memory of the microprocessor 601 that convert information obtained from the angular velocity sensors 218*a*, and torque sensors 802, to a format usable to data manipulation, control, and three dimensional (3D) gaming/simulation routines. The control routines allow the user to adjust damping parameters of the linear damper 500 and the non-linear damper 300 as desired.

The routines are also accessed by the simulation and gaming routines to adjust the damping parameters dynamically during program execution. The data collection routines will be used to provide the user and gaming routines information regarding energy expenditure, angular velocity, force or torque input. The gaming routines are included to stimulate participation in scenarios that encourage various levels of participant energy expenditure to accomplish game and/or exercise goals.

For example, the user can interact with the computer 600 of the apparatus 100 during a exercise session with the apparatus 100, in numerous ways. Three exemplary modes of interaction are described, although numerous other interactions are also possible.

In a first case, the user defines the level of linear or non-linear damping directly, by sending commands via the keypad 116 to the computer 600. The level of damping in this case is held constant. This represents an open loop control scheme between the user and the computer 600.

In the second case, the user adjusts his work output to meet exercise demands set by the computer program during various phases of program execution. The amount of linear or non-linear damping for each phase is programmed independent of what the user's input torque, input velocity or energy expenditure is. The damping levels are quasi-statically maintained during program execution. This is a closed loop control scheme between the user and the computer program but open loop control scheme within the computer program.

In the third case, the computer adjusts the linear or non-linear damping levels depending on the user's work output (as determined by the torque and velocity sensor analysis routines, and what phase of program execution the program is in). The damping levels are dynamically adjusted during program execution. This represents a closed loop type of feedback between the user and the computer program and closed loop feedback control within the computer program.

For example, there may be a program on the computer 600, such that another sculler boater or the like may be shown on the display screen 114. This would cause the user to attempt to keep up with, and try to pass, this hypothetical competitor. This hypothetical competitor is traveling at a reference velocity, that would be displayed on the screen display 114. The computer 600 would be programmed such that this reference velocity is used to adjust the damping of the non-linear 300 and linear 500 dampers, and accordingly, control the damping load on the output drive shaft 234, to simulate the damping of the water, for this user.

Figure 15:
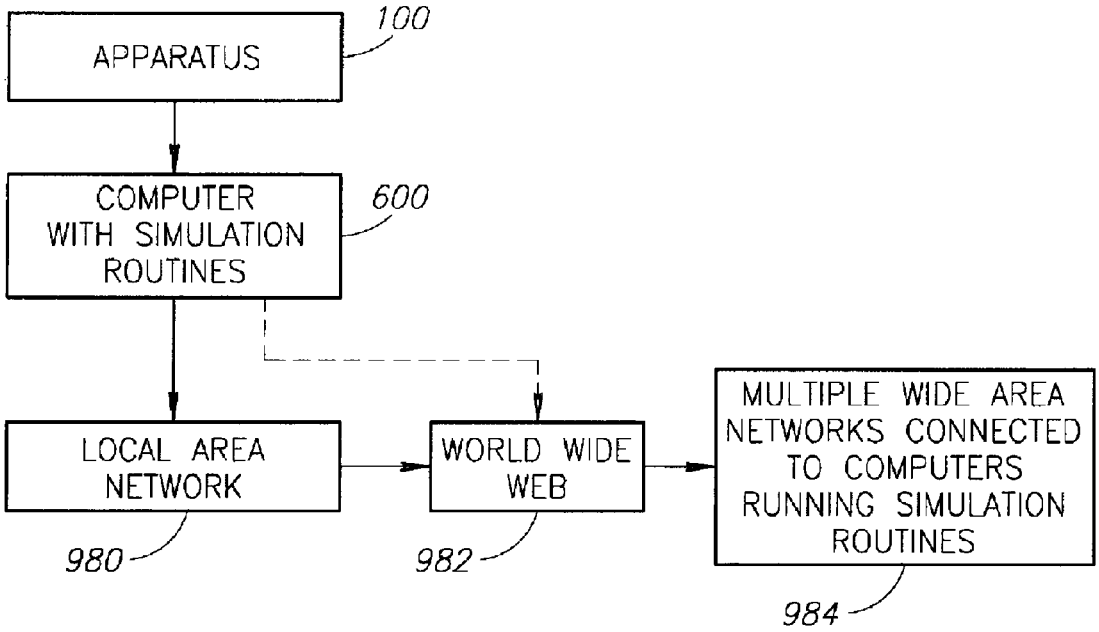
FIG. 15 is a block diagram of the computer system of the apparatus networked to receive various programs or other data entry.

As shown in FIG. 15, the computer 600, through its network interface 604 (FIG. 11) can also be linked (by wired or wireless links) to a local 980 or wide area network 982 (the direct link shown in broken lines), for example, a public network such as the Internet, and allow multiple users to interact with each other in various simulations on a real time basis (box 984) using the apparatus 100 as a user interface.

The processes (methods) and systems, including components thereof herein have been described with exemplary reference to specific hardware and software. The processes (methods) have been described as exemplary, whereby specific steps and their order can be omitted and/or changed by persons of ordinary skill in the art to reduce these embodiments to practice without undue experimentation. The processes (methods) and systems have been described in a manner sufficient to enable persons of ordinary skill in the art to readily adapt other hardware and software as may be needed to reduce any of the embodiments to practice without undue experimentation and using conventional techniques.

While preferred embodiments of the disclosed subject matter have been described, so as to enable one of skill in the art to practice the disclosed subject matter, the preceding description is intended to be exemplary only. It should not be used to limit the scope of the disclosure, which should be determined by reference to the following claims.

What is claimed is:

1. A method for simulating movement along water comprising:

receiving angular velocity and torque data from at least one simulated oar in a rotation about a rotational axis;

determining a damping load for a drive assembly, in communication with the at least one simulated oar, from the received angular velocity and torque data, the damping load including non-linear and linear damping components; and relating through a transmission the received torque data to the received angular velocity data by the following equation:

$$T_i=(J_i+N^2\cdot J_o)\cdot w_{iaa}+((b_i+N^2\cdot(b_o+b_1))\cdot w_i+b_{nl}\cdot N^3\cdot w_i^2$$

wherein $T_i$=input drive torque, $J_i$=input rotational inertia, $J_o$=output rotational inertia, N=transmission multiplying factor or gear factor, $W_i$=input angular velocity, $W_{iaa}$=input angular acceleration, $b_i$=input drag coefficient, $b_o$=output drag coefficient, $b_l$=output linear damping coefficient, and $b_{nl}$=output non-linear damping coefficient.

2. The method of claim 1, additionally comprising: subjecting the drive assembly to the determined damping load.

3. The method of claim 1, wherein the data is in the form of electrical signals.

4. The method of claim 1, wherein the non-linear damping component includes a square law function.

5. The method of claim 1, wherein the linear damping component includes a linear function.

6. The method of claim 1, wherein the linear damping component is provided by a variable linear damper.

7. The method of claim 6, wherein the variable linear damper includes a magnetic damper.

8. The method of claim 1, wherein the non-linear damping component is provided by a variable non-linear damper.

9. The method of claim 8, wherein the variable non-linear damper is selected from the group consisting of air, fluid and viscous dampers.

* * * * *